US008755732B2

(12) United States Patent
Ehara et al.

(10) Patent No.: US 8,755,732 B2
(45) Date of Patent: Jun. 17, 2014

(54) IMAGE FORMING APPARATUS HAVING A TRANSFER UNIT FOR TRANSFERRING AN IMAGE TO A RECORDING SHEET

(75) Inventors: Masanao Ehara, Kanagawa (JP); Naoki Iwaya, Tokyo (JP); Yoshiki Yamaguchi, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 856 days.

(21) Appl. No.: 12/585,578

(22) Filed: Sep. 18, 2009

(65) Prior Publication Data

US 2010/0074667 A1 Mar. 25, 2010

(30) Foreign Application Priority Data

Sep. 19, 2008 (JP) ..... 2008-240780

(51) Int. Cl.
*G03G 15/00* (2006.01)
*G03G 15/08* (2006.01)
*G03G 15/16* (2006.01)

(52) U.S. Cl.
USPC ..... 399/397; 399/121; 399/122

(58) Field of Classification Search
USPC ..... 399/395, 121, 122, 316, 317, 322, 397, 399/68, 400
See application file for complete search history.

(56) References Cited

U.S. PATENT DOCUMENTS 5,003,401 A * 3/1991 Otsuka ..... 348/374
5,802,426 A * 9/1998 Miyazaki et al. ..... 399/113
6,219,520 B1 4/2001 Ehara
6,628,916 B2 9/2003 Yasui et al.
6,636,709 B2 10/2003 Furukawa et al.
6,778,790 B2 8/2004 Yoshinaga et al.
6,785,505 B2 8/2004 Yasui et al.
6,807,386 B2 10/2004 Yasui et al.
6,881,927 B2 4/2005 Yoshinaga et al.
6,882,820 B2 4/2005 Shinshi et al.
6,892,044 B2 5/2005 Yasui et al.
7,022,944 B2 4/2006 Yoshinaga et al.
7,127,204 B2 10/2006 Satoh et al.
7,239,838 B2 7/2007 Sato et al.
7,242,897 B2 7/2007 Satoh et al.
7,313,353 B2 12/2007 Satoh et al.

(Continued)

FOREIGN PATENT DOCUMENTS

JP 02-105165 4/1990
JP 6-183627 7/1994

(Continued)

*Primary Examiner* — Judy Nguyen
*Assistant Examiner* — Justin Olamit
(74) *Attorney, Agent, or Firm* — Harness, Dickey & Pierce, P.L.C.

(57) ABSTRACT

An image forming apparatus includes a transfer unit, a fuser unit, a detector, and an adjustment mechanism. The transfer unit transfers an image from an imaging surface to a recording sheet passing through a transfer nip. The fuser unit fixes the transferred image in place on the recording sheet passing through a fixing nip. The transfer nip and the fixing nip form part of a sheet feed path along which a recording sheet is fed from the fuser unit to the transfer unit. The detector is located between the transfer nip and the fuser unit, and detects an amount of sheet skew by which the fed recording sheet is deviated from a proper position in the sheet feed path. The adjustment mechanism adjusts position of either or both of the transfer unit and the fuser unit according to the detected amount of sheet skew.

10 Claims, 10 Drawing Sheets

(56) References Cited

U.S. PATENT DOCUMENTS

| | | | | |
|---|---|---|---|---|
| 7,319,842 | B2 * | 1/2008 | Koyanagi et al. | 399/395 |
| 7,454,151 | B2 | 11/2008 | Satoh et al. | |
| 7,466,949 | B2 | 12/2008 | Satoh et al. | |
| 7,509,085 | B2 | 3/2009 | Yoshinaga et al. | |
| 7,546,049 | B2 | 6/2009 | Ehara et al. | |
| 8,422,931 | B2 * | 4/2013 | Van Bortel et al. | 399/395 |
| 2002/0018663 | A1 | 2/2002 | Furukawa et al. | |
| 2002/0067936 | A1 | 6/2002 | Yasui et al. | |
| 2003/0000933 | A1 | 1/2003 | Yoshinaga et al. | |
| 2003/0007813 | A1 | 1/2003 | Yasui et al. | |
| 2003/0016963 | A1 | 1/2003 | Yoshinaga et al. | |
| 2003/0206758 | A1 | 11/2003 | Yasui et al. | |
| 2004/0013453 | A1 | 1/2004 | Shinshi et al. | |
| 2004/0042825 | A1 | 3/2004 | Yasui et al. | |
| 2005/0095043 | A1 | 5/2005 | Yoshinaga et al. | |
| 2005/0163543 | A1 | 7/2005 | Satoh et al. | |
| 2006/0116230 | A1 | 6/2006 | Satoh et al. | |
| 2006/0165429 | A1 | 7/2006 | Satoh et al. | |
| 2006/0165443 | A1 | 7/2006 | Yoshinaga et al. | |
| 2006/0257183 | A1 | 11/2006 | Ehara et al. | |
| 2007/0014603 | A1 | 1/2007 | Satoh et al. | |
| 2007/0059036 | A1 * | 3/2007 | Yamada et al. | 399/116 |
| 2008/0063443 | A1 | 3/2008 | Yoshinaga et al. | |
| 2008/0317532 | A1 | 12/2008 | Ehara et al. | |
| 2009/0010687 | A1 | 1/2009 | Yamada et al. | |
| 2009/0123201 | A1 | 5/2009 | Ehara et al. | |
| 2009/0148204 | A1 | 6/2009 | Yoshinaga et al. | |

FOREIGN PATENT DOCUMENTS

| | | | | |
|---|---|---|---|---|
| JP | 9-68871 | | 3/1997 | |
| JP | 2000198590 | A * | 7/2000 | |
| JP | 2001-109215 | | 4/2001 | |
| JP | 2002-244496 | | 8/2002 | |
| JP | 2002244496 | A * | 8/2002 | G03G 21/00 |
| JP | 2006-078557 | | 3/2006 | |
| JP | 2006-232516 | | 9/2006 | |
| JP | 2007178879 | A * | 7/2007 | |

* cited by examiner

IMAGE FORMING APPARATUS HAVING A TRANSFER UNIT FOR TRANSFERRING AN IMAGE TO A RECORDING SHEET

CROSS-REFERENCE TO RELATED APPLICATIONS

The present patent application claims priority pursuant to 35, U.S.C. §119, from Japanese patent Application No. 2008-240780 filed on Sep. 19, 2007,, which is hereby incorporated by reference herein in its entirety.

BACKGROUND OF THE INVENTION

1. Field of the Invention

The present invention relates to an image forming apparatus, such as a photocopier, facsimile, printer, plotter, or multifunctional machine having several of such imaging functions, and more particularly, to an electrophotographic image forming apparatus having a transfer unit to transfer an image from a photoconductor or intermediate transfer member to a recording sheet of paper or plastic film, and a fuser unit to fix the transferred image in place on the recording sheet.

2. Discussion of the Background

In electrophotographic image formation, an electrostatic latent image is formed through charging and subsequent optical scanning of a rotating photoreceptive surface such as a drum or belt. Thereafter, a developing device renders the latent image into visible form with toner. The photoconductive surface after development is advanced to a transfer device in which the toner image is transferred to a recording material, such as a paper sheet or plastic film, either directly or via an intermediate transfer member by passing through a transfer nip. Then, the recording sheet is forwarded to a fixing device in which the powder toner image is fused in place, for example, with heat and pressure applied to the recording sheet passing through a fixing nip.

In constructing such an electrophotographic imaging system, proper positioning of the transfer device and the fusing device is fundamental to good imaging and sheet feeding performance of the image forming apparatus. Misalignment of the transfer nip and the fixing nip results in displacement of images produced in the transfer and fixing processes, or curling and wrinkling of recording sheets traveling along the sheet feed path.

Conventional image forming apparatuses are designed with transfer and fuser units individually positioned and supported by a main frame of the apparatus. In order for the two devices to work properly in conjunction with each other, the conventional design requires dimensional control with close tolerances and precise alignment during manufacture, leading to high manufacturing costs and structural complexity. Moreover, even products that meet such high precision requirements can suffer lack of alignment and hence degraded imaging and sheet feeding performance when operated under various different conditions as specified by individual users.

SUMMARY OF THE INVENTION

Exemplary aspects of the present invention are put forward in view of the above-described circumstances, and provide a novel image forming apparatus.

In one exemplary embodiment, the novel image forming apparatus includes a transfer unit, a fuser unit, a detector, and an adjustment mechanism. The transfer unit transfers an image from an imaging surface to a recording sheet passing through a transfer nip. The fuser unit fixes the transferred image in place on the recording sheet passing through a fixing nip. The transfer nip and the fixing nip form part of a sheet feed path along which a recording sheet is fed from the fuser unit to the transfer unit. The detector is located between the transfer nip and the fuser unit, and detects an amount of sheet skew by which the fed recording sheet deviates from a proper position in the sheet feed path. The adjustment mechanism adjusts position of either or both of the transfer unit and the fuser unit according to the detected amount of sheet skew.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF PREFERRED EMBODIMENTS

Figure 1:
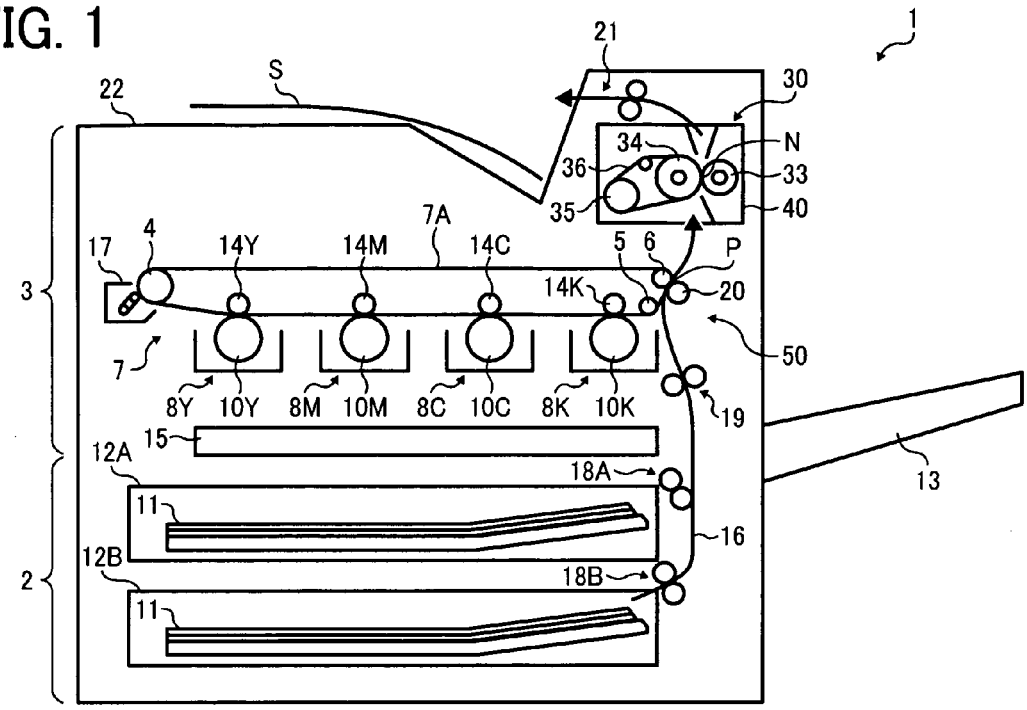
FIG. 1 schematically illustrates an image forming apparatus according to one embodiment of this patent specification.

In describing exemplary embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Referring now to the drawings, wherein like reference numerals designate identical or corresponding parts throughout the several views, exemplary embodiments of the present patent application are described.

FIG. 1 schematically illustrates an image forming apparatus 1 according to one embodiment of this patent specification.

As shown in FIG. 1, the image forming apparatus 1 is configured as an electrophotographic tandem color printer, with a lower sheet feeding section 2 and an upper printing section 3.

In the image forming apparatus 1, the sheet feeding section 2 includes stacked sheet trays 12A and 12B, each accommodating a stack of recording media such as sheets of paper 11. The printing section 3 includes multiple imaging units 8Y, 8M, 8C, and 8K, an intermediate transfer unit 7, a scanning unit 15, a fuser unit 30, and a transfer roller 20 forming part of a transfer unit 50.

In the middle of the printing section 3, the imaging units 8Y, 8M, 8C, and 8K are arranged in series, each having a photoconductive drum 10 surrounded by a charging device, a developing device, a cleaning device, not shown, all of which are integrated into a single unit for removable installation in the image forming apparatus 1. Each of the imaging units 8 uses toner of a particular primary color as indicated by the reference letters, "Y" for yellow, "M" for magenta, "C" for cyan, and "K" for black, communicating with a toner bottle, not shown, to supply the developing device with such color toner when required. Below the series of imaging units 8 lay the scanning unit 15, including laser sources, not shown, to optically scan the photoconductive drums 10 from beneath.

The intermediate transfer unit 7 extends above the imaging units 8, including an intermediate transfer belt 7A looped around multiple rollers 4, 5, and 6 and primary transfer rollers 14Y, 14M, 14C, and 14K, and equipped with a belt cleaner 17, all of which are integrated into a single unit for removable installation in the image forming apparatus 1. The intermediate transfer belt 7A is an endless flexible belt, passing through naps or gaps defined between each primary transfer roller 14 and photoconductive drum 10, between the roller 4 and the belt cleaner 17, and between the roller 6 and the transfer roller 20.

On one side of the intermediate transfer unit 7, the transfer unit 50 forms a transfer nip p between the transfer roller 20 and the belt supporting roller 6 pressed against each other through the intermediate transfer belt 7A. Although not depicted in FIG. 1, the transfer unit 50 includes several components associated with the transfer roller 20, all of which are housed in a pivot able transfer housing 52 forming part of a relative positioning mechanism according to this patent specification as described later in more detail.

Above the transfer unit 50 lies the fuser unit 30, with a pressure roller 33, a fixing roller 34, a heat roller 35, a looped, heat-isolative fixing belt 36, and other components associated with such transfer members, all enclosed in a fuser housing 40 removable installed in the image forming apparatus 1 and provided with a fine adjustment mechanism according to this patent specification as described later in more detail. The fuser unit 30 forms a fixing nip N between the pressure roller 33 and the fixing roller 34 pressed against each other through the fixing belt 36, which extends substantially in parallel alignment with the transfer nip p in the direction in which the view is taken.

Alongside the sheet feeding section 2 and the printing section 3, a sheet feed path 16 is defined by various rollers and guide members, such as upper and lower pairs of pickup rollers 18A and 18B, a pair of registration rollers 19, an output device 21, etc., along which a recording sheet S travels upward from the sheet tray 12 or a manual feed tray 13 toward the transfer nip p and the fixing nip N to settle into an output tray 22 external to the apparatus body.

During operation, the printing section 3 forms toner images of primary colors on the photoconductive drums 10, combines the multiple images into a single multicolor image on the intermediate transfer belt 7A, and transfers the composite toner image onto a recording sheet S fed to the transfer nip p along the sheet feed path 16 from the sheet feed section 2, followed by fixing the toner image with heat and pressure at the fixing nip N.

Specifically, in each imaging unit 14, a motor, not shown, rotates the photoconductive drum 10 clockwise in the drawing to sequentially pass through various imaging processes. First, the charging device uniformly charges an outer surface of the photoconductive drum 10 to a given polarity. The charged surface is then exposed to a modulated laser beam emitted by the scanning unit 15. The laser exposure forms an electrostatic latent image on each photoconductive surface according to image data of each separate color component, i.e., yellow, magenta, cyan, or black, contained in a multicolor image to be reproduced. The rotating photoconductive surface then meets the developing device, where the electrostatic latent image is developed into visible form with toner of the corresponding color.

In the intermediate transfer unit 7, a motor, not shown, drives one or more of the rollers 4, 5, and 6 so that the intermediate transfer belt 7A travels counterclockwise in the drawing. As a given area of the traveling belt 7A meets the yellow imaging unit 8Y, the magenta imaging unit 8M, the cyan imaging unit 8C, and the black imaging unit 8K in a timed sequence, the toner image on each photoconductive drum 10 is transferred to the incoming area of the intermediate transfer belt 7A with the primary transfer roller 14 applying a bias voltage. As a result, yellow, magenta, cyan, and black toner images are superimposed one atop another to form a full-color toner image on the intermediate transfer belt 7A.

After the intermediate transfer process, the photoconductive drum 10 has its surface cleaned of residual toner by the cleaning device. The photoconductive surface is then discharged to an initial potential by the discharging device in preparation for the next imaging cycle.

In the sheet feeding section 2, the pickup rollers 18A and 18B rotate to feed a recording sheet S from the sheet stack 11 to the sheet feed path 16. Alternatively, a user may place a recording sheet S in the manual feed tray 13 for feeding to the sheet feed path 16. Upon entering the sheet feed path 16, the recording sheet S is held by the registration rollers 19, and advances upward to the transfer nip p in registration with the movement of the intermediate transfer belt 7A.

At the transfer nip p, the full-color image formed on the belt surface is transferred to the recording sheet S passing through the transfer nip p, where a voltage of a polarity opposite that of the charge on the toner image is applied to the transfer roller 20. Thereafter, the belt cleaning device 17 removes residual toner remaining on the intermediate transfer belt 7A, and the recoding sheet S is forwarded to the fuser unit 30.

In the fuser unit 30, the powder toner image on the recording sheet S is fused in place with heat and pressure as the recording sheet S passes through the fixing nip N. Subsequently, the recording sheet S bearing a finished image thereon reaches the end of the sheet feed path 16 for delivery to the output tray 22 by the output device 21.

Figure 2:
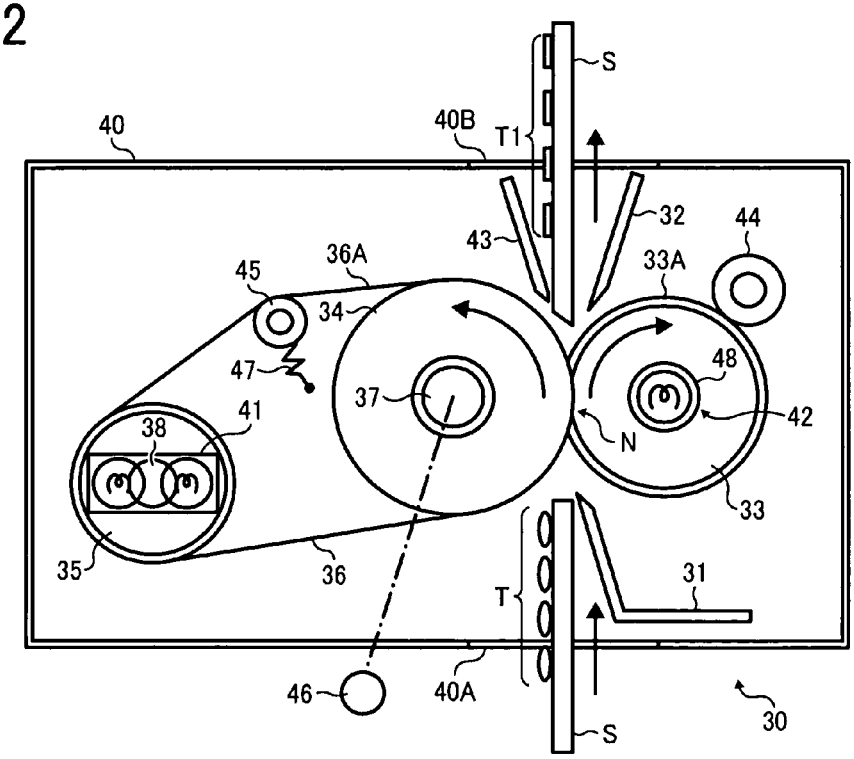
FIG. 2 illustrates in detail a basic configuration of a fuser unit included in the image forming apparatus of FIG. 1.

FIG. 2 illustrates in detail a basic configuration of the fuser unit 30 included in the image forming apparatus 1.

As shown in FIG. 2, the fuser unit 30 includes an inlet sheet guide 31, an outlet sheet guide 32, a sheet separator 43, a cleaning roller 44, and a spring-loaded tension roller 45 in addition to the pressure roller 33, the fixing roller 34, the heat roller 35, and the fixing belt 36, all enclosed in the position-adjustable fuser housing 40.

In the fuser unit 30, the pressure roller 33 and the fixing roller 34 rotate against each other while pressing against each other through the fixing belt 36 at the fixing nip N, which is heated by the heat roller 35 and the pressure roller 33 applying heat to the fixing belt 36 rotating around the rollers 34 and 35 in synch with the rollers 33 and 34.

Specifically, the pressure roller 33 is a hollow metal cylinder mounted on a displaceable shaft 48 rotatable supported on the fuser housing 40, containing a heater 42 (e.g., a halogen heater) inside the cylinder to heat the fixing nip N. Similarly, the heat roller 35 has a shaft 38 rotatable supported on the fuser housing 40 to define a fixed axis of rotation, containing heaters 41 (e.g., halogen heaters) to heat the fixing belt 36. It is to be noted that the position, number, and type of the heaters 41 and 42 may be other than those depicted in the drawings according to the specific configuration of the fuser unit 30.

The fixing roller 34 is a cylinder made of elastic material such as rubber, mounted on a stationary shaft 37 rotatable supported on the fuser housing 40 to define a fixed axis of rotation. The fixing roller shaft 37 is connected to a rotary motor 46 to impart a driving force to rotate the fixing roller 34, which in turn rotates the fixing belt 36 and the pressure roller 33 in accordance with the fixing roller rotation.

Figure 3A:
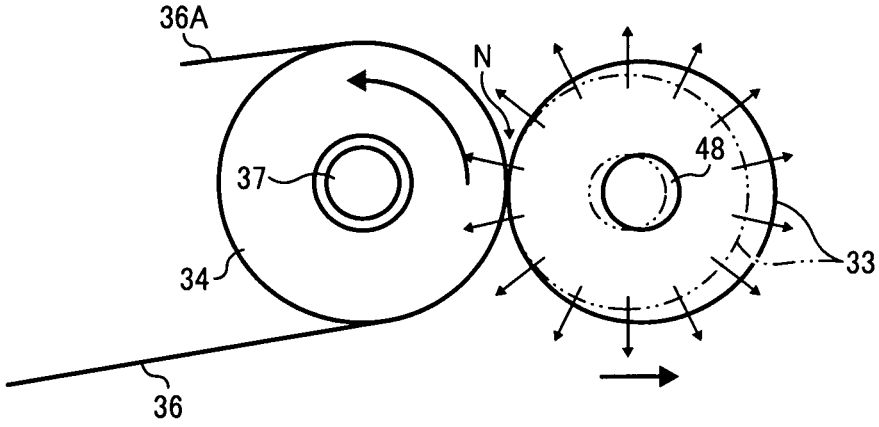
FIGS. 3A and 3B illustrate a pair of rollers defining a fixing nip in the fuser unit of FIG. 2.
Figure 3B:
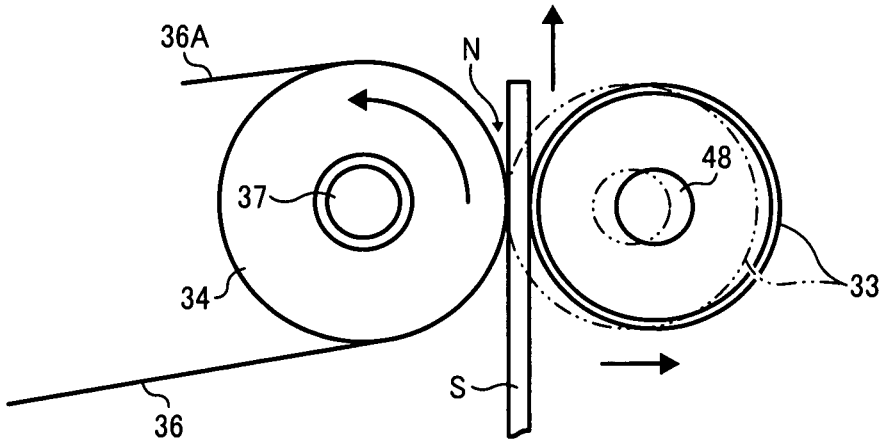

In the present embodiment, the position of the pressure roller 33 or its shaft 48 is adjustable with respect to the fixing roller 34. For example, with further reference to FIGS. 3A and 3B, the roller shaft 48 is slightly retracted from the fixing roller 34 in a substantially horizontal direction when the diameter of the pressure roller 33 increases due to thermal expansion of metallic material, or when the thickness of a recording sheet S entering the fixing nip N requires adjustment of the gap between the pressing rollers 33 and 34.

Referring back to FIG. 2, the tension roller 45 is located inside the loop of the fixing belt 36, equipped with a spring 47 pressing it against the inner surface of the fixing belt 36 to maintain proper tension on the fixing belt 36.

The inlet sheet guide 31 is located between an inlet opening 40A and the fixing nip N, and the outlet sheet guide 32 is located between the fixing nip N and an outlet opening 40B, each mounted on the fuser housing 40 on the side of the pressure roller 33.

The sheet separator 43 is an elongated plate extending along the rotational axis of the fixing roller 34, with a functional edge, either toothed or non-toothed, spaced away from the surface of the fixing roller 34. The sheet separator 43 serves to separate a recording sheet S from the surface 36A of the fixing belt 36 as the sheet S advances toward the outlet opening 40B after passing through the fixing nip N.

The cleaning roller 44 extends along the rotational axis of the pressure roller 33 with an outer surface thereof in contact with the surface of the pressure roller 33. The cleaning roller 44 is provided to remove residual toner and paper dust adhering to the pressure roller 33, but may be omitted depending on the configuration.

The fuser housing 40 has the inlet opening 40A and the outlet opening 40B communicating with the sheet feed path 16, allowing entry and exit of a recording sheet S bearing a toner image T thereon. The fuser components recited above are positioned within this enclosure housing 40, and therefore are inaccessible to a user or to maintenance personnel without opening or disassembling the fuser housing 40.

During operation, a recording sheet S bearing a powder toner image T thereon enters the fuser housing 40 via the inlet opening 40A and advances along the inlet guide 31. At the fixing nip N, the rollers 33 and 34 rotate against each other, the former clockwise and the latter counterclockwise in the drawing, to pass the incoming sheet S therebetween. s the sheet S passes through the fixing nip N, heat and pressure exerted on the recording sheet S renders the toner image T into a fixed permanent print T1. The recording sheet S is then separated from the fixing belt 36 by the sheet separator 43, and advances to the outlet opening 40B along the outlet guide 32.

Figure 4:
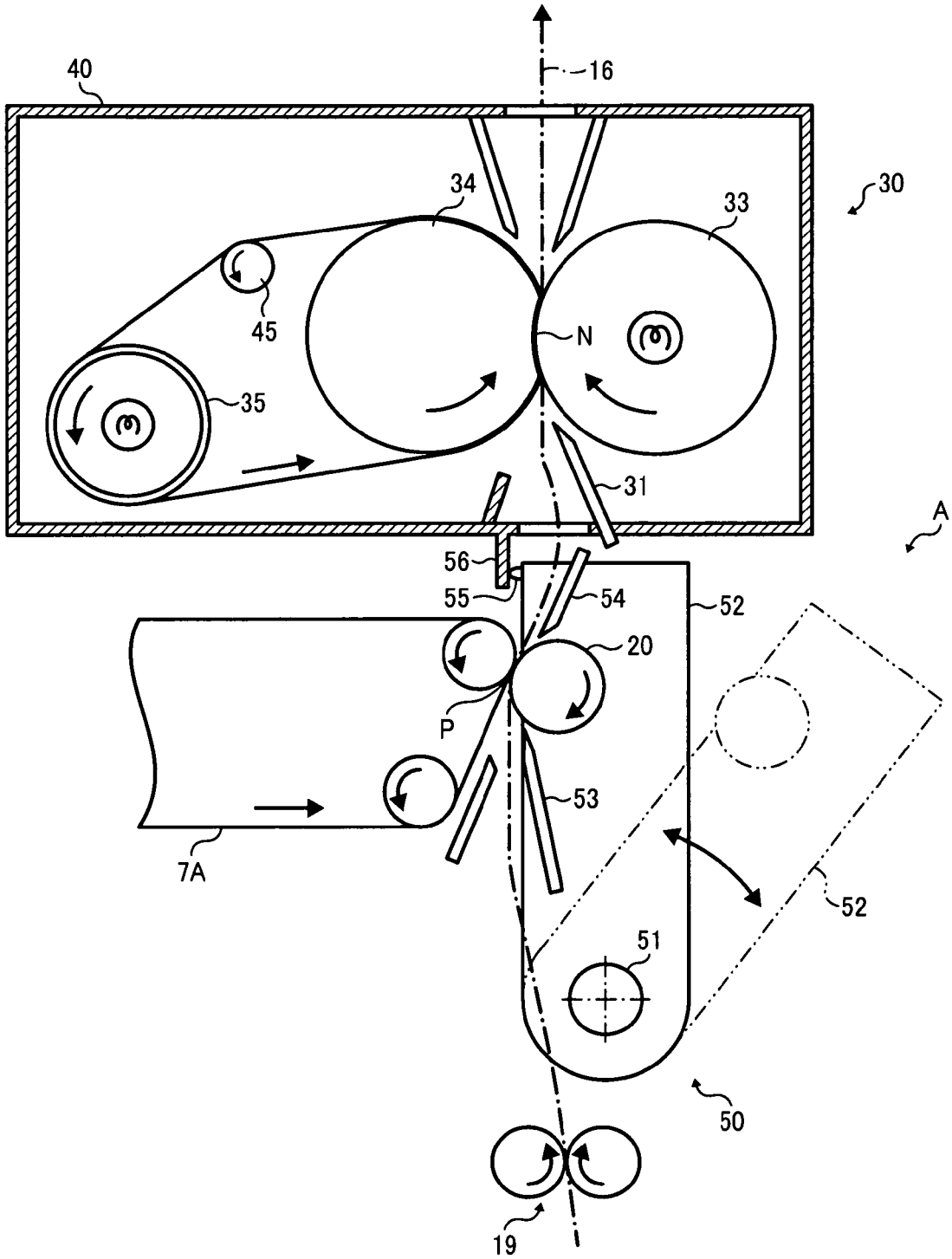
FIG. 4 schematically illustrates a relative positioning mechanism positioning the fuser unit and a transfer unit relative to each other in the image forming apparatus of FIG. 1.

FIG. 4 schematically illustrates a relative positioning mechanism A positioning the fuser unit 30 and the transfer unit 20 relative to each other in the image forming apparatus 1.

As shown in FIG. 4, the relative positioning mechanism A includes the transfer housing 52 supported on a pivot axis 51 for pivoting between a substantially upright position (depicted in solid lines) and a retracted position (depicted in dotted lines). The transfer housing 52 has a contact portion 55 at an end distal from the pivot axis 51, which meets a flange 56 extending downward from the fuser housing 40 when the transfer housing 52 is in the upright position. In addition to the transfer roller 20 described above, the transfer housing 52 contains a lower sheet guide 53 for guiding a recording sheet S to enter the transfer nip p and an upper sheet guide 54 for guiding a recording sheet S to exit from the transfer nip p.

In such a configuration, the relative positioning mechanism A positions the transfer unit 50 relative to the fuser unit 30 by contacting the contact portion 55 with the flange 56, with a suitable biasing member, not shown, holding the transfer housing 52 in the upright position (i.e., against the flange 56).

Thus, by directly positioning the transfer unit 50 against the fuser unit 30, the relative positioning mechanism A establishes the relative position of each unit without involving alignment with a main frame of the image forming apparatus 1. This effectively prevents misalignment between the transfer unit 50 and the fuser unit 30 due to an accumulation of dimensional errors present in different parts of the image forming apparatus 1. It is to be appreciated that the size, shape, number, and/or location of the contact portion 55 and the flange 56 may be suitably designed to minimize the effects of dimensional tolerance stack-up.

Although the configuration depicted above has the transfer housing pivotable with respect to the fuser housing, conversely, it is also possible to provide a contact portion on a pivotable fuser housing and a flange on a stationary transfer housing, and position the fuser housing against the transfer housing.

Additionally, the sheet guides 54 and 31 may be configured as two separate plates mounted on the transfer housing 52 and the fuser housing 40, respectively, or as a single continuous plate mounted on either one of the transfer housing 52 and the fuser housing 40. Although the single-plate configuration provides lower manufacturing cost, the dual-plate configuration allows ready adjustment of the shape and position of the sheet feed path 16, particularly when used with the relative positioning mechanism A facilitating adjustment of the horizontal and vertical gaps between the separate guide plates.

In addition to being capable of readily and reliably positioning the transfer housing 52 and the fuser housing 40 relative to each other, the image forming apparatus 1 according to this patent specification can fine-tune the relative positions of the fuser unit 30 and the transfer unit 50 to obtain proper parallel alignment between the fixing nip N and the transfer nip p. The following describes embodiments of such fine adjustment mechanisms according to this patent specification.

Figure 5:
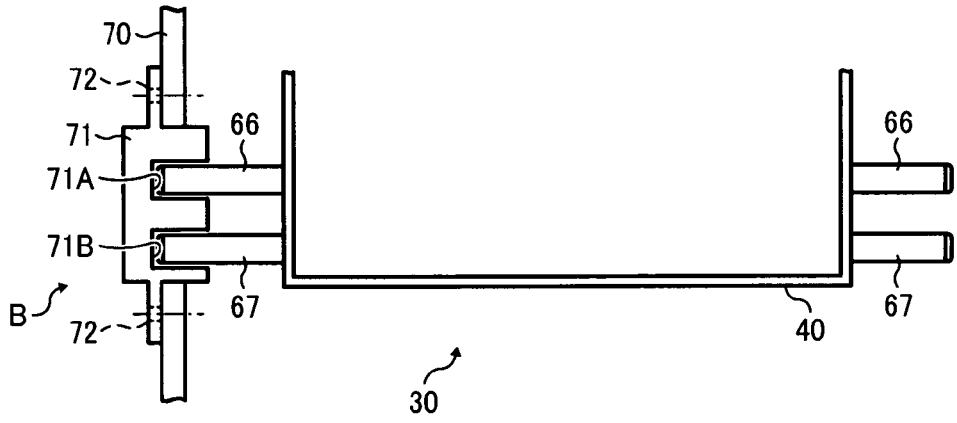
FIG. 5 schematically illustrates a fine adjustment mechanism incorporated in the image forming apparatus of FIG. 1 according to one embodiment of this patent specification.

FIG. 5 schematically illustrates a fine adjustment mechanism B incorporated in the image forming apparatus 1 according to one embodiment of this patentspecification, in which some components of the fuser unit 30 (e.g., the flange 56 and the internal rollers and guide members) are omitted for simplicity.

As shown in FIG. 5, the fine adjustment mechanism B includes an adjustment plate 71 having a pair of guide grooves 71A and 71B for accommodating a pair of parallel pins 66 and 67 projecting from a side of the fuser housing 40, as well as a set of screw holes 72 for securing on a main frame 70 of the image forming apparatus 1.

Figure 6:
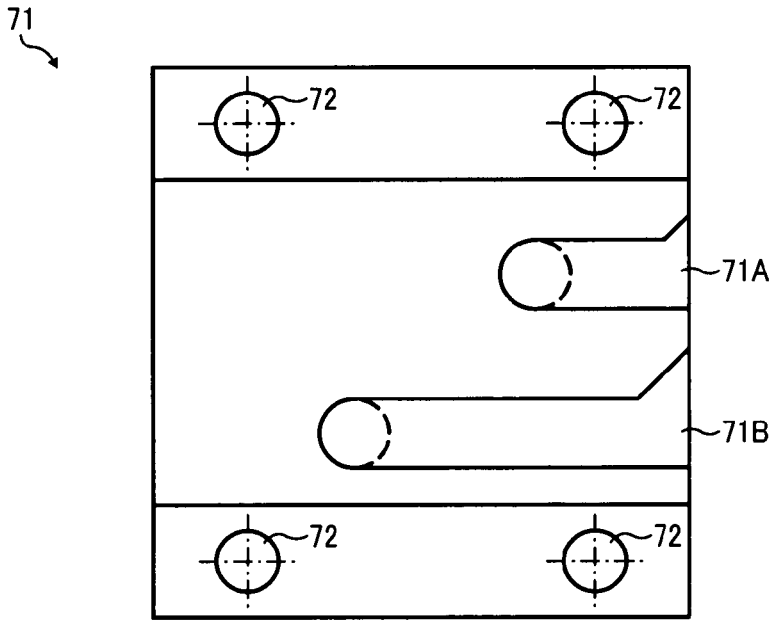
FIG. 6 shows a view of an adjustment plate included in the fine adjustment mechanism of FIG. 5.

With additional reference to FIG. 6, which shows another view of the adjustment plate 71 of the fine adjustment mechanism B, the guide grooves 71A and 71B are cut substantially parallel to each other to guide therealong the parallel pins 66 and 67 of the fuser housing 40 during installation, each terminating at a rounded end in which the accommodated pin is fixed with a suitable lever-operable fastener, not shown. The screw holes 72 are larger in diameter than screws used to secure the adjustment plate 71 on the main frame 70, and such clearance inside the screw holes 72 allows repositioning of the adjustment plate 71 on the apparatus frame 70 to fine-tune the position of the fuser housing 40 in the image forming apparatus 1.

While not depicted in the drawing, the fuser unit 30 has a train of drive gears to transmit driving force to components of the fuser unit 30 mounted on a side of the fuser housing 40. preferably, the fine adjustment mechanism B is provided on the side opposite to that from which the driving force is transmitted, so that fine tuning the alignment between the fixing nip N and the transfer nip p by the adjustment mechanism B does not interfere with engagement of the gear train nor affect proper operation of the fuser unit 30. Nevertheless, it is also possible to configure the fine adjustment mechanism B to have a pair of adjustment plates provided on opposite sides of the fuser housing 40.

The operability of the fine adjustment mechanism B is increased by providing alignment marks on the apparatus frame 70, where it is operated by human users. Moreover, coupling the fine adjustment mechanism B with a suitable drive unit enables automatic operation without user intervention. Further, handling of the adjustment plate 71 is facilitated using suitable tuning equipment as described below with reference to FIGS. 7, 8A, 8B, and 8C.

Figure 7:
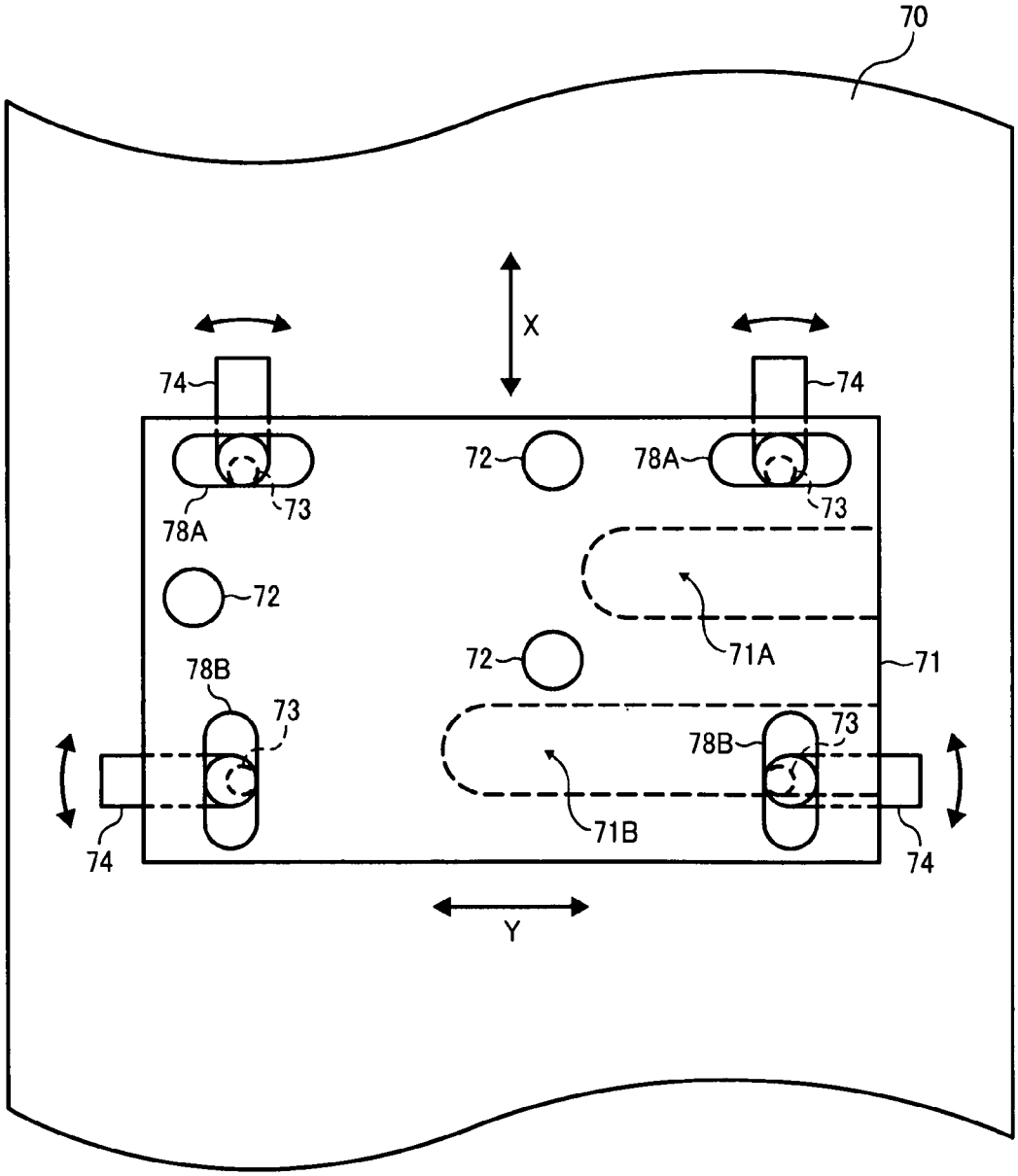
FIG. 7 schematically illustrates the adjustment plate of FIG. 6 arranged with equipment for fine-tuning the position with respect to an apparatus frame.

FIG. 7 schematically illustrates the adjustment plate 71 arranged with equipment for fine-tuning the position with respect to the frame 70 of the image forming apparatus 1.

As shown in FIG. 7, the adjustment plate 71 has a pair of horizontal guide slots 78A in the upper corners and a pair of vertical guide slots 78B in the lower corners, and is connected to the apparatus frame 70 via a set of adjustment levers 74. Each adjustment lever 74 is held in the guide slot 78 of the plate 71 on one side and in a slot 73 of the apparatus frame 70 on another side, having a free end pointing upward or sideward to project beyond the edges of the adjustment plate 71.

Figure 8A:
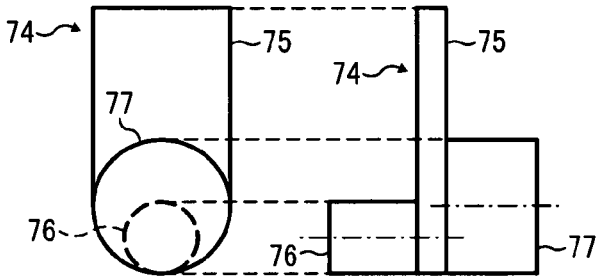
FIGS. 8A through 8C illustrate in detail components included in the fine-tuning equipment of FIG. 7.
Figure 8B:
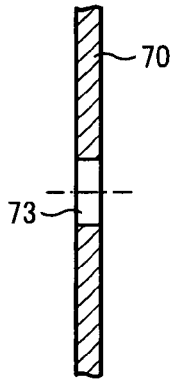
Figure 8C:
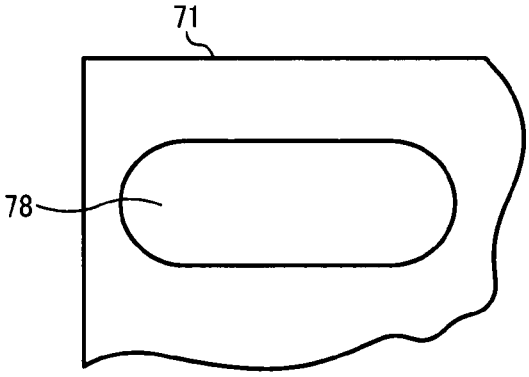

With additional reference to FIGS. 8A through 8C, it can be seen that the adjustment lever 74 has first and second cylindrical protrusions 76 and 77 of unequal size formed on opposite sides of a flat handle 75 with their axes offset from each other (FIG. 8A). The first protrusion 76 is sized to tightly fit in the slot 73 of the apparatus frame 70 (FIG. 8B), and the second protrusion 77 is sized to movably fit within the guide slot 78 of the adjustment plate 71 (FIG. 8C).

In such a configuration, rotating each adjustment lever 74 in the horizontal slot 78A displaces the second protrusion 77 relative to the first protrusion 76, which in turn causes the adjustment plate 71 to shift in a vertical direction X substantially perpendicular to the horizontal slots 78A. Similarly, rotating each adjustment lever 74 in the vertical slot 78B displaces the second protrusion 77 relative to the first protrusion 76, which in turn causes the adjustment plate 71 to shift in a horizontal direction Y substantially perpendicular to the vertical slots 78B.

It is known that effects of misalignment between the transfer and fixing nips p and N differ depending on the direction in which the nips are displaced relative to each other. For example, vertical misalignment causes creases or folds on recording sheets and deformation of transferred toner images, whereas horizontal misalignment results in smearing or fading of printed images. The directional movement of the adjustment plate 71 enables the fine adjustment mechanism B to individually correct vertical and horizontal misalignments between the transfer nip p and the fixing nip N, thereby preventing maladjustment and concomitant adverse effects due to mixing up the vertical and horizontal directions X and Y in repositioning the adjustment plate 71.

Figure 9A:
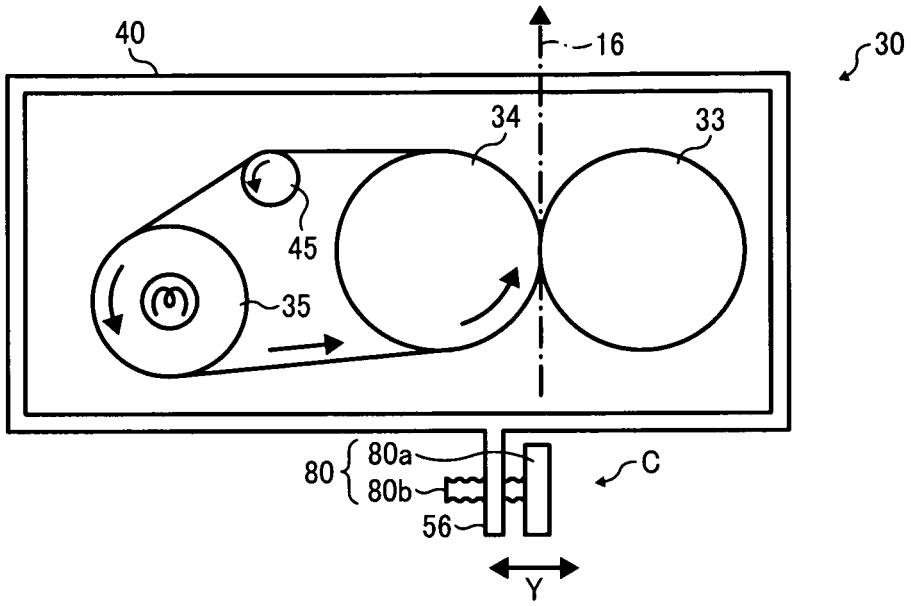
FIGS. 9A and 9B schematically illustrate another fine adjustment mechanism incorporated in the image forming apparatus of FIG. 1 according to one embodiment of this patent specification.
Figure 9B:
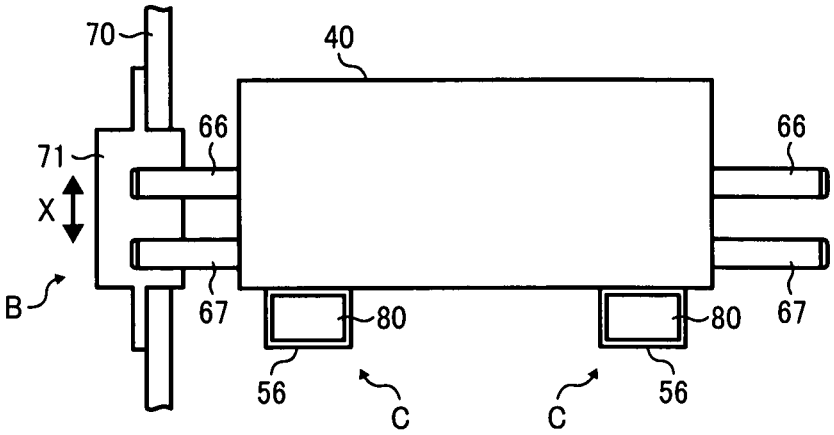

FIGS. 9A and 9B schematically illustrate another fine adjustment mechanism C incorporated in the image forming apparatus 1 according to one embodiment of this patent specification.

As shown in FIGS. 9A and 9B, the fine adjustment mechanism C includes a pair of flathead screws 80 only one of which is shown in FIG. 9A, each with a screw head 80*a*, to face the contact portion 55 of the transfer housing 52, not shown, and a threaded body 80*b*, screwed into the flange 56 of the fuser housing 40.

In such a configuration, moving the flathead screw 80 through the flange 56 enables repositioning the screw head 80*a*, relative to the contact portion 55 in the horizontal direction Y, allowing for fine-tuning the position of the transfer housing 52 defined by the relative positioning mechanism A. Instead of the screw 80 provided on the flange 56 of the fuser housing 40, alternatively, it is possible to provide the screw-based fine adjustment mechanism C on the contact portion 55 of the transfer housing 52.

The screw-based fine adjustment mechanism C may be used in conjunction with the plate-based fine adjustment mechanism B. The combined use of the two adjustment mechanisms B and C allows fine adjustment of the relative positions of the fuser unit 30 and the transfer unit 50 in both the vertical and horizontal directions X and Y, providing flexibility and accuracy of adjustment compared to a configuration using only a single adjustment mechanism.

Having described the relative positioning and position adjustment mechanisms incorporated in the image forming apparatus 1, the following describes sheet skew detection also incorporated for use in conjunction with those positioning mechanisms.

As mentioned earlier, misalignment between the transfer nip p and the fixing nip N can adversely affect proper sheet feeding and printing capabilities of the image forming apparatus 1. Various defects attributable to misaligned transfer and fixing nips occur when a recording sheet S is skewed or deviated from a proper position in the sheet feed path 16 due to a lack of parallelism between the transfer nip p and the fixing nip N.

Figure 10A:
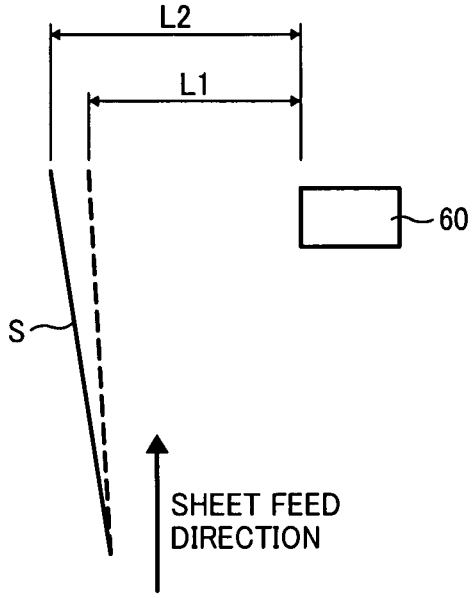
FIGS. 10A and 10B show examples of sheet deviations to be handled with a sheet skew detector incorporated in the image forming apparatus of FIG. 1.
Figure 10B:
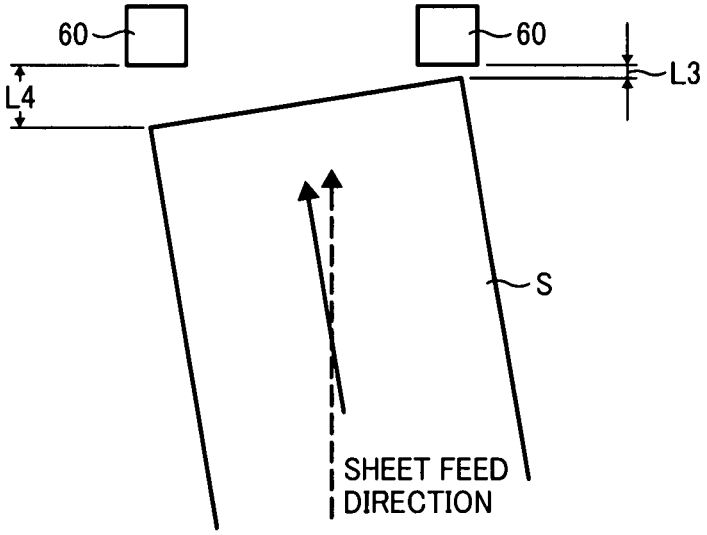

Examples of sheet deviations are shown in FIGS. 10A and 10B, in which the recording sheet S has its longitudinal axis (represented by a solid line) angled from a reference axis (represented by a dotted line) parallel to the sheet feed path 16 of the image forming apparatus 1. If not corrected, improperly feeding a recording sheet in the sheet feed path would create creases or folds on the recording sheet, and develop defects on an image printed on the recording sheet.

To effectively handle sheet deviations in the sheet feed path 16, the image forming apparatus 1 according to this patent specification includes a sheet skew detector 60 to detect a position and orientation of a recording sheet S traveling from the transfer unit 50 to the fuser unit 30, and to calculate a sheet skew or deviation, i.e., the amount by which the recording sheet S deviates from a proper reference plane or position in the sheet feed path 16. According to the detection results, fine adjustment of the relative positions of the fuser and transfer units 30 and 50 is performed to correct or reduce the sheet skew, thereby ensuring proper functioning of the sheet feeder and the transfer and fuser units 30 and 50.

Specifically, as shown in FIG. 10A, the sheet skew detector 60 detects the position of the surface of a recording sheet S at a measurement point adjacent to the sheet feed path 16 to obtain a distance L2 from the measurement point to the surface of the incoming sheet S. Then, the sheet skew detector 60 calculates an amount of rotation of the sheet axis relative to a predetermined reference axis by comparing the actual distance L2 against a reference distance L1 that is a distance from the measurement point to the reference axis parallel to the sheet feed path 16, that is, a distance from the measurement point to the surface of a recording sheet S in the reference position.

Alternatively, as shown in FIG. 10B, the sheet skew detector 60 may detect the position of the leading edge of a recording sheet S at multiple measurement points on opposing sides of the sheet feed path 16 to obtain a distance L3 from the first measurement point to the leading edge of the incoming sheet S at one side, and a distance L4 from the second measurement point to the leading edge of the incoming sheet S at another side. In this case, the sheet skew detector 60 calculates an amount of rotation of the sheet axis relative to the direction of sheet feed path based on a difference between L3 and L4.

Figure 11:
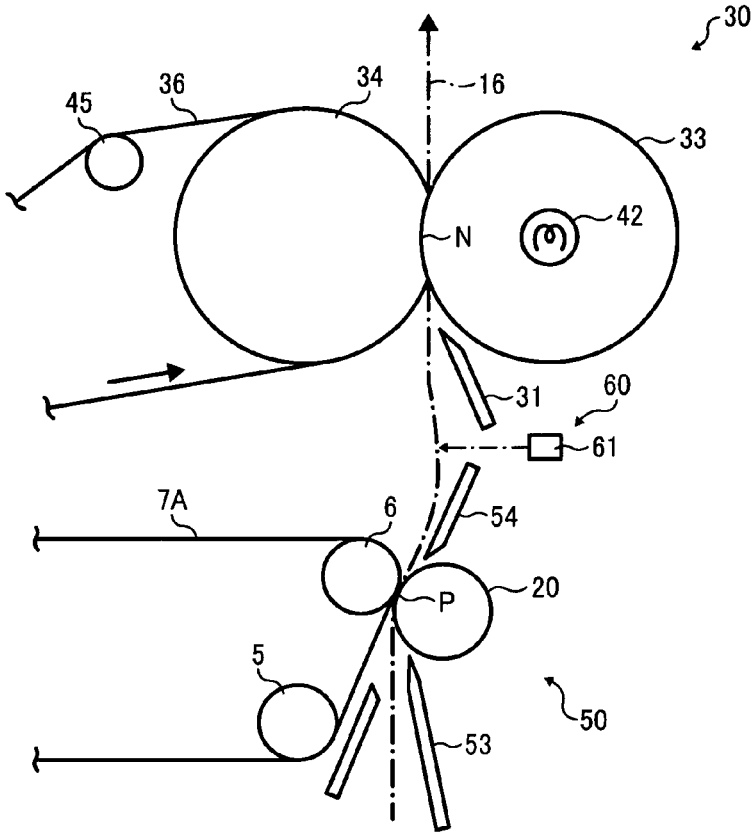
FIG. 11 schematically illustrates a disposition of the sheet skew detector according to one embodiment of this patent specification.
Figure 12:
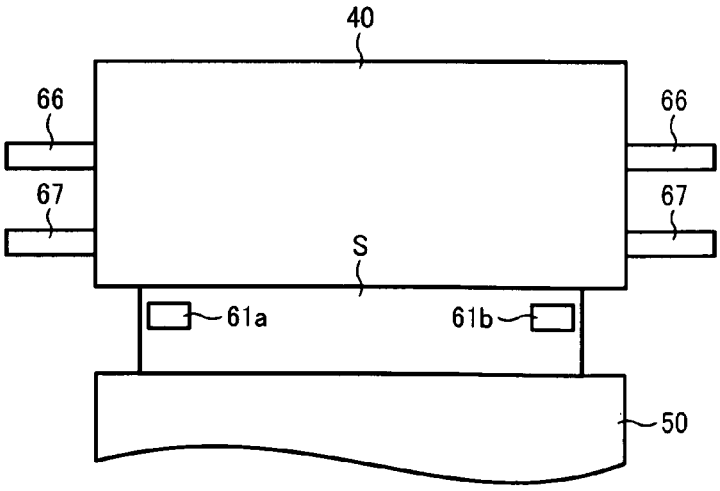
FIG. 12 schematically illustrates another arrangement of the sheet skew detector according to one embodiment of this patent specification.

FIGS. 11 and 12 schematically illustrates arrangements of the sheet skew detector 60 according to one embodiment of this patent specification.

As shown in FIG. 11, the sheet skew detector 60 includes a distance sensor 61 (e.g., a laser displacement sensor or an optical distance sensor) located at a measurement point between the transfer nip p and the fuser unit 30 to measure a distance between the measurement point and the surface of a recording sheet S during delivery from the transfer nip p to the fixing nip N.

preferably, as shown in FIG. 12, the sheet skew detector 60 includes a pair of displacement sensors 61*a*, and 61*b*, positioned at a pair of measurement points equidistant from the reference plane, the former on the left side and the latter on the right side in the sheet feed path 16, each to measure a distance between the measurement point and the surface of a recording sheet S during delivery from the transfer nip p to the fixing nip N. The configuration with multiple displacement sensors allows the sheet skew detector 60 to detect a sheet skew more reliably than is possible with a single displacement sensor.

More preferably, each of the sensors 61*a*, and 61*b*, is directed toward a specific point slightly inward from a side edge of a recording sheet S in the reference position, e.g., a point approximately 5, to 10, millimeters inward from a side edge of a properly positioned recording sheet having a width of 305, millimeters, which is the maximum sheet width size that can be processed in the image forming apparatus 1 of the present embodiment.

Each displacement sensor 61 outputs a signal representing an amount D by which the surface of a recoding sheet S is displaced from the predetermined reference plane or position. For example, the amount of displacement D output by the sensor 61 is 0, when the recoding sheet S is in the proper reference position, exceeds 0, when the recoding sheet S deviates from the reference position toward the measurement point, and falls below 0, when the recording sheet S deviates from the reference position away from the measurement point.

Figure 13:
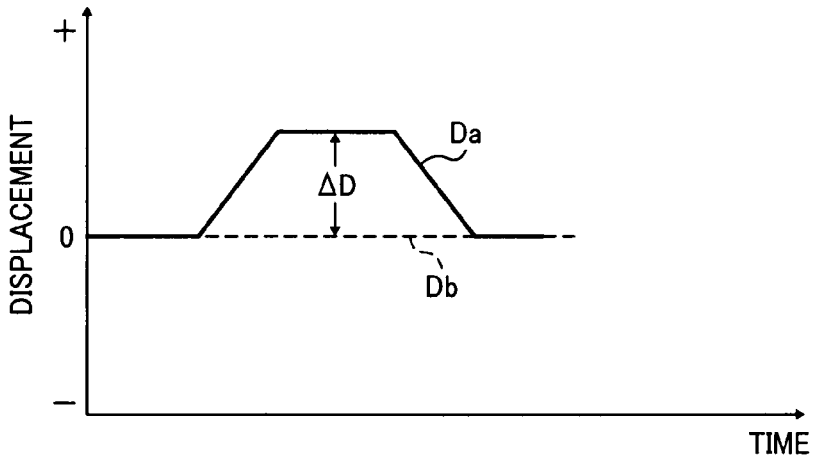
FIG. 13 is a graph showing outputs of displacement sensors included in the sheet skew detector of FIG. 12.

FIG. 13 is a graph showing outputs Da and Db of the displacement sensors 61*a*, and 61*b*, obtained as a recording sheet S passes from the transfer nip p to the fuser unit 30.

As shown in FIG. 13, the output Da of the left-side sensor 61*a*, shifts to positive values as the recording sheet S passes through the measurement point, while the output Db of the right-side sensor 61*b*, remains at 0, throughout the sheet passage. This results in an amount of skew or difference ΔD between the outputs Da and Db of the left- and right-side sensors 61*a*, and 61*b*,, indicating that the incoming recording sheet S is asymmetrically displaced relative to the reference position. If not corrected, such asymmetric displacement would result in undesirable creases or folds on the recording sheet improperly fed into the fuser unit 30.

The measurement results output by the displacement sensors 61*a*, and 61*b*, are used to determine whether or not, and how, to perform position adjustment to correct a sheet skew in the paper feed path 16. For example, when the left-side displacement Da is greater than the right-side displacement Db, indicating presence of a sheet skew ΔD, the positions of the rollers and guide members defining the sheet feed path 16 (i.e., the sheet guides 53 and 54, and various components of the transfer unit 50 and the fuser unit 30) are adjusted to reduce the left-side displacement Da toward the right-side displacement Db to remove the difference ΔD between Da and Db.

Such position adjustment may be performed either automatically or manually. In manual adjustment, the amount of displacement D may be displayed on an operational panel for confirmation by a user. Advantageously, using the fine adjustment mechanisms incorporated in the image forming apparatus 1 allows ready and reliable fine-tuning of the position of the transfer unit 50 or the fuser unit 30 and/or the relative positions of both units 50 and 30 in both the horizontal and vertical directions.

Figure 14:
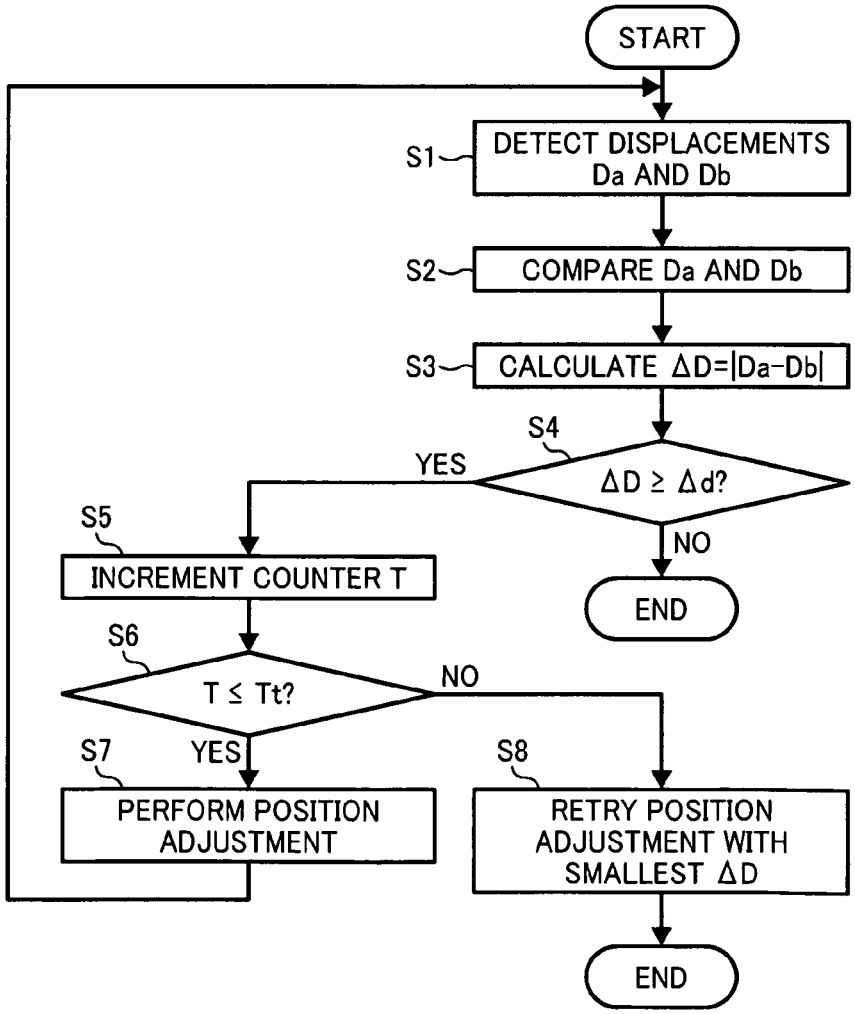
FIG. 14 is a flowchart illustrating of skew detection and position adjustment in the image forming apparatus of FIG. 1 according to one embodiment of this patent specification.

FIG. 14 is a flowchart illustrating skew detection and position adjustment in the image forming apparatus 1 according to one embodiment of this patent specification.

First, upon detecting a recording sheet S entering the sheet feed path 16, the sheet skew detector 60 determines displacements Da and Db on opposite sides of the recording sheet S as the sheet S passes between the displacement sensors 61*a*, and 61*b*, (step S1).

The sheet skew detector 60 compares the left- and right-side displacements Da and Db against each other (step S2), obtains an amount of skew as a difference ΔD between Da and Db (step S3), and then compares the sheet skew ΔD against a predetermined allowable limit Δd of, for example, 2 millimeters (step S4).

When the sheet skew ΔD is within the allowable limit Δd ("NO" in step S4), the sheet skew detector 60 terminates the operation without position adjustment. When the sheet skew ΔD exceeds the allowable limit Δd ("YES" in step S4), the sheet skew detector 60 increments a counter T counting the number of times position adjustment is carried out (step S5) and determines whether the counter T exceeds a predetermined allowable limit Tt of, for example, 2, (step S6).

When the adjustment count T is within the allowable limit Tt ("YES" in step S6), the sheet skew detector 60 indicates to a user or a driving unit to perform one or more of position adjustments to reduce the difference ΔD between the left- and right-side displacements Da and Db (step S7). Such position adjustment processes include manipulating the flathead screw 80 of the screw-based fine adjustment mechanism C and shifting the adjustment plate 71 of the plate-based adjustment mechanism B as described in FIG. 5 through 9B. After the adjustment process is completed, the operation returns to step S1.

When the adjustment count T exceeds the allowable limit Tt, indicating that position adjustment is repeated more than the predetermined number of times Tt ("NO" in step S6), the sheet skew detector 60 terminates the operation by indicating to retry a position adjustment process that can minimize the sheet skew ΔD (step S8).

Thus, the image forming apparatus 1 according to this patent specification can effectively enable adjustment of the relative positions of the transfer unit 50 and the fuser unit 30 according to the sheet skew detector 60 indicating a sheet skew in the sheet in the sheet feed path 16, thereby preventing misalignment between the transfer nip p and the fixing nip N, and ensuring proper functioning of the sheet feeder and the transfer and fuser units.

In further embodiments, the image forming apparatus 1 may include an additional adjustment mechanism other than those depicted in FIGS. 5 through 9B to adjust positions of the transfer unit 50 and the fuser unit 30 according to the sheet skew detector 60 indicating a sheet skew in the sheet feed path 16.

Further, it is possible to diagnose the condition of the sheet feed path 16 using the sheet skew detector 60 readings and adjust the position(s) of the fuser unit and the transfer unit when a new process unit, be it a fuser or a transfer unit, is installed for replacement purposes. This effectively removes misalignment arising from dimensional variations present in specific products, and prevents concomitant failures in sheet transport and printing performance of the image forming apparatus 1.

Such diagnosis and adjustment may take place when a user or service personnel initializes the new process unit, for example, by resetting memory storing information, such as usage history, number of recording sheets processed, number of prints created, etc., in which case the diagnosis may be initiated by the sheet feeder automatically feeding a recording sheet into the sheet feed path, and the position adjustment be performed automatically or manually.

Furthermore, it is also possible to diagnose the condition of the sheet feed path 16 using the sheet skew detector 60 readings and adjust the position(s) of the fuser unit and the transfer unit with the fine adjustment mechanism when a predetermined number of recording sheets are processed through the sheet feed path 16. This effectively removes misalignment arising from deterioration over time, and prevents concomitant failures in sheet transport and printing performance of the image forming apparatus 1.

Moreover, it is also possible to diagnose the condition of the sheet feed path 16 using the sheet skew detector 60 readings and adjust the position(s) of the fuser unit and the transfer unit by the fine adjustment mechanism each time one or more recording sheets are loaded into the sheet feed tray, which may be detected by suitable sensors mounted on the sheet feed trays 12 and 13. This effectively removes misalignment arising from variations in the type of recording sheets in use, or from varying compatibilities between the sheet type and the sheet feed process, and prevents concomitant failures in sheet transport and printing performance of the image forming apparatus 1.

Numerous additional modifications and variations are possible in light of the above teachings. It is therefore to be understood that, within the scope of the appended claims, the disclosure of this patent specification may be practiced otherwise than as specifically described herein.

What is claimed is:

1. An image forming apparatus, comprising:

a transfer unit to transfer an image from an imaging surface to a recording sheet passing through a transfer nip;

a fuser unit to fix a transferred image in place on the recording sheet passing through a fixing nip;

the transfer nip and the fixing nip forming part of a sheet feed path along which a recording sheet is fed from the transfer unit to the fuser unit;

a detector located between the transfer nip and the fuser unit to detect an amount of sheet skew by which the fed recording sheet is deviated from a proper position in the sheet feed path;

an adjustment mechanism having an adjustment plate, displaceable in a vertical direction and a horizontal direction, with elongated guide grooves that accommodate pins that project from a side of a fuser housing that houses the fuser unit and elongated horizontal and vertical slots;

rotatable adjustment levers movably fitted into the elongated horizontal and vertical slots, the adjustment mechanism being configured to adjust a relative position of the transfer unit and the fuser unit by rotation of the rotatable adjustment levers in the elongated horizontal and vertical slots of the adjustment plate to obtain proper parallel alignment between the transfer nip and the fixing nip according to the detected amount of sheet skew, the detector includes a pair of sensors to measure a distance between a measurement point and a surface of a recording sheet in the sheet feed path, each sensor being directed to a point slightly inboard of a side edge of a properly positioned recording sheet having a maximum width that the image forming apparatus can accommodate in the sheet feed path, and the sheet feed path extends generally upward between the fuser unit and the transfer unit, such that the fixing nip is positioned above the transfer nip.

2. The image forming apparatus according to claim 1, further comprising:

a relative positioning mechanism to position the transfer unit and the fuser unit relative to each other by contacting a contact portion formed on one of the transfer unit and the fuser unit with a flange formed on the other of the transfer unit and the fuser unit.

3. The image forming apparatus according to claim 2, wherein the flange includes a fine-tuning member having a threaded body extending therefrom.

4. The image forming apparatus according to claim 1, wherein the detector performs sheet skew detection to initiate position adjustment by the adjustment mechanism when the fuser unit is replaced.

5. The image forming apparatus according to claim 1, wherein the detector performs sheet skew detection to initiate position adjustment by the adjustment mechanism when the transfer unit is replaced.

6. The image forming apparatus according to claim 1, wherein the detector performs sheet skew detection to initiate position adjustment by the adjustment mechanism when a predetermined number of recording sheets are processed through the sheet feed path.

7. The image forming apparatus according to claim 1, wherein the detector performs sheet skew detection to initiate position adjustment by the adjustment mechanism each time one or more recording sheets are loaded into a sheet feed tray.

8. The image forming apparatus according to claim 1, wherein the transfer unit is positioned directly against the fuser unit.

9. The image forming apparatus according to claim 1, wherein the guide grooves are cut substantially parallel to each other to guide the pins.

10. The image forming apparatus according to claim 1, wherein the adjustment levers have first and second cylindrical protrusions of unequal size formed on opposite sides with respective axes of the first and second cylindrical protrusions offset from each other.

* * * * *